United States Patent [19]

Greier et al.

[11] 4,391,238

[45] Jul. 5, 1983

[54] AIR-COOLED INTERNAL COMBUSTION ENGINE

[75] Inventors: Josef Greier; Colin T. Pomfret, both of Graz, Austria

[73] Assignee: Hans List, Graz, Austria

[21] Appl. No.: 247,745

[22] Filed: Mar. 26, 1981

[30] Foreign Application Priority Data

Mar. 31, 1980 [AT] Austria ..... 1747/80

[51] Int. Cl.[3] ..... F02F 1/02

[52] U.S. Cl. ..... 123/193 C; 123/193 CH

[58] Field of Search ..... 123/41.67, 41.83, 41.84; 123/193 R, 193 CH, 193 C

[56] References Cited

U.S. PATENT DOCUMENTS 1,938,566 12/1933 Birkigt ..... 123/41.83
2,712,812 7/1955 Ruckstell ..... 123/193.41

FOREIGN PATENT DOCUMENTS 214209 3/1961 Austria .
491137 5/1919 France .
260480 11/1926 United Kingdom .

*Primary Examiner*—Craig R. Feinberg
*Attorney, Agent, or Firm*—Watson, Cole, Grindle & Watson

[57] ABSTRACT

An air-cooled internal combustion engine has a cylinder barrel which is detachably fastened in an opening of the crankcase by means of a bearing ring screwed from the inside of the crankcase on an external thread of the cylinder barrel. A flange of the bearing ring lies close to the inner surface of the crankcase and a ring nut is screwed from the outside of the crankcase on an external thread on the bearing ring, whereby the cylinder barrel is fixedly secured relative to the crankcase.

6 Claims, 3 Drawing Figures

AIR-COOLED INTERNAL COMBUSTION ENGINE

BACKGROUND OF THE INVENTION

The present invention relates to an air-cooled internal combustion engine which comprises a crankcase with an opening therein, a cylinder barrel which is detachably fastened to this opening, and a bearing ring which is arranged in the opening and has a flange lying close to the inner side of the crankcase. The cylinder barrel has an external thread in the region of the opening in the crankcase and is screwed in the bearing ring.

DESCRIPTION OF THE PRIOR ART

An internal combustion engine of the kind mentioned above is known, e.g., from British Pat. No. 260,480, which shows the disadvantage that the cylinder barrel is vertically not adjustable, as the cylinder barrel shows a flange which is secured by a clamping ring on the one side and a bearing ring on the other side. Furthermore, as far as this known engine is constructed as a multi-cylinder engine, the horizontal extension of the cooling fins is limited, as the cylinder barrel has to be screwed in the bearing ring—that means it has to be turned about its axis—whereby cooling fins which have—seen in the direction of the axis of the cylinder—substantially square or rectangular shape and are lying close to one another with their adjoining rims cannot be used.

In another air-cooled internal combustion engine which is known, e.g., from Austrian Pat. No. 214 209, the cylinder barrel shows a flange at its lower end which lies close to a shoulder arranged in a partly threaded bore in the crankcase and a threaded ring is used to force the flange against the shoulder. In this embodiment it is also impossible to adjust the vertical height of the cylinder barrel.

From U.S. Pat. No. 2,721,812 an internal combustion engine is known which has a cylinder barrel with a smooth outer circumference onto which a threaded sleeve is soldered. The threaded sleeve has at its lower end a flange and builds a preformed assembly unit together with the cylinder barrel. Thereby, the cylinder barrel of this known engine can be used only in connection with a bipartite crankcase, which is divided in a plane comprising the cylinder axes.

SUMMARY OF THE PRESENT INVENTION

It is an object of the present invention to avoid the disadvantages of the known embodiments and to improve an internal combustion engine of the kind mentioned above in such a way that the cylinder barrel is vertically adjustable and that the horizontal extension of the cooling fins is not limited by the necessity to allow for the attachment of the cylinder barrel. Furthermore, the attachment and adjustment of the cylinder barrel should be simplified.

According to this invention this can be achieved in an air-cooled internal combustion engine of the aforementioned kind with a bearing rim for the cylinder barrel which has an external thread in the region outside the crankcase, and a ring nut which is screwed on the external thread of the bearing ring and braced to the outside of the crankcase. Thereby, the bearing ring is fixed by the ring nut which is screwed on the bearing ring from the outside of the crankcase. An adjustment of the gap between the bottom of the cylinder head and the upper rim of the piston in the top dead centre position is possible via a more or less deep screwing of the cylinder barrel in the bearing ring. For the vertically adjustment of the cylinder barrel the bearing ring can be turned about its axis as the angular position of the cylinder barrel with regard to a turn about the cylinder axis is usually determined by the given position of, e.g., the inlet and outlet port of the cylinder head. This would not be possible in the aforementioned embodiments as, e.g., the embodiment known from British Pat. No. 260,480 has a bearing ring which is secured in its position relatively to the crankcase by means of screws or bolts.

Furthermore, a lock nut can be srewed on an external thread of the cylinder barrel in the region outside the crankcase and be braced to the bearing ring, whereby the cylinder barrel is protected against torsion. With this embodiment it is possible to protect the angular position of the cylinder barrel in one operation with the attachment and adjustment thereof. According to a further feature of the invention it is further advantageous if the lock nut is screwed on the same external thread of the cylinder barrel as the bearing ring.

According to another feature of this invention the bearing ring shows handling means such as grooves or bores, for the business end of a tool, e.g., a hooked wrench, in the region outside the crankcase. Due to that, the vertical adjustment of the attached cylinder barrel, which is done at a fixed radial position of the cylinder barrel by turning the bearing ring, is significantly simplified. Further, it is also possible by that means to apply a relatively great fixing force.

DESCRIPTION OF THE DRAWINGS

The present invention is hereinafter more specifically described with reference to the accompanying drawings, wherein.

DESCRIPTION OF THE PREFERRED EMBODIMENTS

Figure 1:
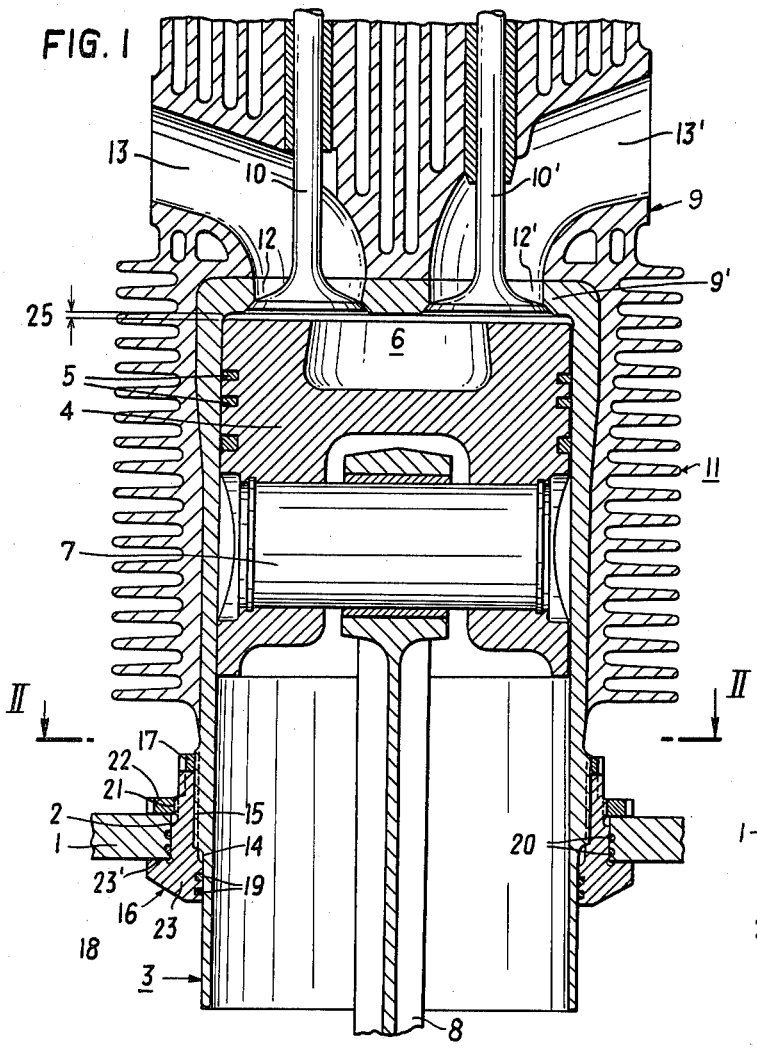
FIG. 1 shows a partially sectional view of an internal combustion engine according to this invention.

An internal combustion engine (not specifically shown) comprises a crankcase 1 which has an opening 2 for every cylinder, a cylinder barrel 3 being detachably fastened in each opening 2. A piston 4 is guided in each cylinder barrel 3, which seals a combustion chamber 6 by means of piston rings 5 against the cylinder barrel 3 and coacts via a bolt 7 and a connecting rod 8 with a crankshaft (not shown). In the depicted embodiment the cylinder bottom 9' is made in one piece with the cylinder barrel 3 and includes inlet and outlet openings 12, 12' which are controlled by valves 10, 10'. A cooling jacket 11 is made in one piece with the cylinder head 9 and is attached separately to the cylinder bottom 9' or the upper part of the cylinder barrel 3, respectively. The cylinder head 9 is provided with canals 13, 13' which are associated with the valves 10, 10' and the openings 12, 12' of each cylinder barrel.

The cylinder barrel 3 has an external thread 15 on a lower jacket part 14, which lies in the region of the opening 2 of the crankcase 1 when the cylinder barrel is mounted. The external thread 15 coacts with a bearing ring 16 and a lock nut 17. The sealing of the inner space 18 of the crankcase 1 in the region of the opening 2 is done by annular sealings 19 and 20, which are arranged in the gaps between crankcase 1 and bearing ring 16, and between bearing ring 16 and cylinder barrel 3.

The bearing ring 16 has an external thread 21 in the region protruding from the crankcase 1 when the bearing ring is attached in the opening 2. A ring nut 22 is screwed on the external thread 21, by means of which the bearing ring 16, which lies close to the inner surface of the crankcase 1 with a shoulder 23' of a flange 23, is fixed in the opening 2.

The lock nut 17, the part of the bearing ring 16 which lies above the external thread 21, and the ring nut 22 include grooves 24 (FIG. 2) at their outer circumferences for coaction with the business end of hooked wrench.

The operation of the depicted embodiment with regard to the attachment of the cylinder barrel can be described as follows:

The bearing ring 16 is inserted from the inside of the crankcase 1 into the opening 2, e.g., during the assembly of the crankcase, so that the shoulder 23' of the bearing ring 16 lies close to the inner surface of the crankcase. In this position the bearing ring 16 is fixed relative to the opening 2 by loosely tightening thereon the ring nut 22. After screwing the lock nut 17 on the external thread 15 of the cylinder barrel 3 up to the upper end of the thread near the cooling fins, the cylinder barrel 3 is screwed in the thread of the bearing ring 16 which corresponds to the external thread 15.

To adjust the width of the gap 25 between the upper rim of the piston 4 in the upper dead centre position and the cylinder bottom 9', not the cylinder barrel 3 but the bearing ring 16, which is loosely fixed by the ring nut 22 in the opening 2, is turned about the cylinder axis by means of a hooked wrench (not shown) which coacts with the grooves 24. Due to that, the vertical height of the cylinder barrel 3 is continuously adjustable while the gap 25 between the piston 4 in its upper dead centre position and the cylinder bottom 9' can be measured simultaneously, whereby an exact adjustment of the gap 25—at fixed radial position of the canals 13, 13'—is possible in one operation together with the attachment of the cylinder barrel. After the adjustment of the cylinder barrel, the bearing ring 16 is fixed in the opening 2 by locking the ring nut 22, and after that the position of the cylinder barrel 3 relatively to the bearing rim 16 and the crankcase 1 is secured by locking the lock nut 17.

Figure 3:
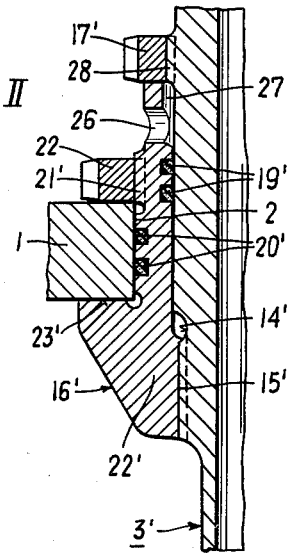
FIG. 3 shows a detail of another embodiment according to this invention in a sectional view according to FIG. 1 at enlarged scale.

In the embodiment depicted in FIG. 3 the cylinder barrel 3' comprises an external thread 15' on a circumferential part 14' which lies within the crankcase 1. The external thread 15' engages with a corresponding thread on the bearing ring 16' only in a region lying within the crankcase 1. The bearing ring 16' is sealed by means of annular sealings 19' and 20' against the cylinder barrel 3' and against the crankcase 1 and shows a shoulder 23' on a flange 22', which lies close to the inner surface of the crankcase 1. An external thread 21' is provided on the bearing ring 16' in the region protruding from the opening 2 of the crankcase 1, which thread coacts with a ring nut 22 which fastens the bearing ring 16' in the opening 2. The bearing ring 16' shows bores 26 at its circumference in the region above the external thread 21'. Together with a relief 27 to the cylinder barrel 3', the bores 26 allow for the engagement of the business end of a suitable turning tool when the cylinder barrel 3' is attached and adjusted.

A further external thread 28 is provided on the cylinder barrel 3' in the region lying above the bearing ring 16' when the cylinder barrel is attached. A lock nut 17' is screwed on the external thread 28, by means of which the attached cylinder barrel 3' can be secured relatively to the bearing ring 16' and therefore, relatively to the crankcase 1.

Figure 2:
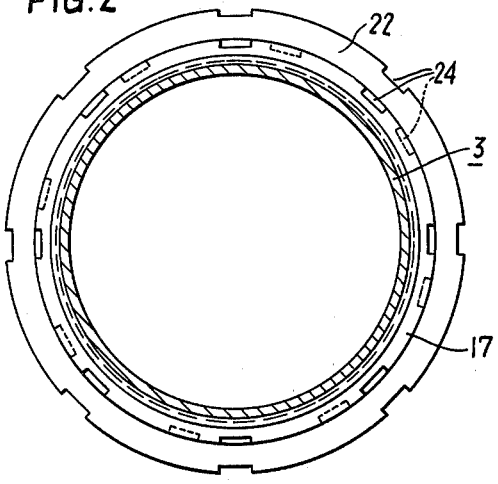
FIG. 2 shows a sectional view along line II—II of FIG. 1.

The attachment and adjustment of the cylinder barrel 3' is done in the same way as already described with reference to the embodiment of FIGS. 1 and 2.

The clamping force or fixing force of lock nut, bearing ring, and ring nut is evenly distributed over the entire circumference of the cylinder barrel in both of the depicted embodiments, whereby no one-sided load of the cylinder barrel and no one-sided wear can occur.

I claim:

1. An air-cooled internal combustion engine which comprises a crankcase which defines an inner space and an outer space, said crankcase including at least one opening therein which communicates between the inner space and the outer space; a cylinder barrel fitted in each opening to extend from the inner space to the outer space, each cylinder barrel including a first external threaded portion located along the length thereof in the region of the associated opening and a second external threaded portion located along the length thereof in the outer space; a bearing ring positioned between each cylinder barrel and the associated opening in which it fits, each bearing ring extending from the inner space to the outer space and including a flange portion located in the inner space which is abuttable against the portion of the crankcase forming the associated opening, an internal threaded portion which is cooperable with at least said first external threaded portion of the associated cylinder barrel, and an outer threaded portion located on a portion thereof which is in the outer space; a ring nut screwed on said outer threaded portion of each bearing ring to brace the bearing ring to the portion of the crankcase forming the associated opening; and a lock nut screwed on said second external threaded portion of each cylinder barrel to brace the cylinder barrel to the associated bearing ring.

2. The air-cooled internal combustion engine as defined in claim 1 wherein each bearing ring includes sealing rings which sealingly abut against the associated cylinder barrel and sealing rings which sealingly abut against the portion of the crankcase which forms the opening in which it fits.

3. The air-cooled internal combustion engine as defined in claim 1 wherein each bearing ring includes grooves in its outer circumference to enable easy rotation by a tool.

4. The air-cooled internal combustion engine as defined in claim 1 wherein the first and second external threaded portions of each cylinder barrel form a continuous threaded region along the outside of the cylinder barrel.

5. The air-cooled internal combustion engine as defined in claim 4 wherein each bearing ring includes sealing rings in its flange portion which sealingly abut against the outside of the associated cylinder barrel.

6. The air-cooled internal combustion engine as defined in claim 5 wherein the portion of each crankcase which forms an opening includes sealing rings which sealingly abut against the associated bearing ring fitted therein.

* * * * *